US009416797B2

(12) United States Patent
Van Wijk

(10) Patent No.: US 9,416,797 B2
(45) Date of Patent: Aug. 16, 2016

(54) CAPPING STACK AND METHOD FOR CONTROLLING A WELLBORE

(75) Inventor: Johannes Van Wijk, Rijswijk (NL)

(73) Assignee: Shell Oil Company, Houston, TX (US)

( * ) Notice: Subject to any disclaimer, the term of this patent is extended or adjusted under 35 U.S.C. 154(b) by 183 days.

(21) Appl. No.: 14/111,031

(22) PCT Filed: Apr. 13, 2012

(86) PCT No.: PCT/EP2012/056738

§ 371 (c)(1),
(2), (4) Date: Oct. 10, 2013

(87) PCT Pub. No.: WO2012/140178

PCT Pub. Date: Oct. 18, 2012

(65) Prior Publication Data

US 2014/0034337 A1 Feb. 6, 2014

(30) Foreign Application Priority Data

Apr. 14, 2011 (EP) ..... 11162347

(51) Int. Cl.

| | |
|---|---|
| ***E21B 33/06*** | (2006.01) |
| ***E21B 33/064*** | (2006.01) |
| ***F15B 1/26*** | (2006.01) |
| ***F15B 1/02*** | (2006.01) |
| *F15B 3/00* | (2006.01) |

(52) U.S. Cl.

CPC ..... *F15B 1/265* (2013.01); *E21B 33/06* (2013.01); *E21B 33/061* (2013.01); *E21B 33/064* (2013.01); *F15B 1/022* (2013.01); *F15B 3/00* (2013.01)

(58) Field of Classification Search

CPC ..... E21B 33/06; E21B 33/064
See application file for complete search history.

(56) References Cited

U.S. PATENT DOCUMENTS

| | | | | |
|---|---|---|---|---|
| 1,777,564 | A * | 10/1930 | Hosmer | E21B 33/06 12/146 D |
| 4,580,628 | A | 4/1986 | Schaeper | |
| 7,216,714 | B2 | 5/2007 | Reynolds | |
| 2006/0037758 | A1 * | 2/2006 | Reynolds | E21B 33/035 166/368 |
| 2008/0104951 | A1 | 5/2008 | Springett | |
| 2012/0324876 | A1 * | 12/2012 | Fuselier | E21B 33/0355 60/327 |

FOREIGN PATENT DOCUMENTS

WO 2008154486 A2 12/2008

OTHER PUBLICATIONS

PCT International Search Report, Application No. PCT/EP2012/056738 dated Jul. 16, 2012.

* cited by examiner

*Primary Examiner* — Catherine Loikith

(57) ABSTRACT

The invention discloses a system and method for controlling a wellbore. The method comprises the steps of: providing a capping stack comprising a number of releasable modules, each module having a size and weight within predetermined limits, wherein said modules include at least one ram type blow out preventer module, and wherein said modules include a connector module for connecting the capping stack to an attachment point of the wellbore; transporting said modules by cargo airplane to a location near the wellbore; interconnecting the modules to provide the capping stack; and connecting the capping stack to the attachment point of the wellbore.

11 Claims, 16 Drawing Sheets

CAPPING STACK AND METHOD FOR CONTROLLING A WELLBORE

PRIORITY CLAIM

The present application which is a 371 application of PCT/EP2012/056738, filed Apr. 13, 2012, claims priority from European Application 11162347.6, filed Apr. 14, 2011.

The present invention relates to a capping stack and to a method for controlling a wellbore. The capping stack and method can be used to control a well when conventional containment systems have failed.

In search of hydrocarbon reservoirs, wellbores are being drilled in more remote areas and/or in deeper water. Wellbores have already been drilled in water depths which exceed 2,500 m and increased drilling in arctic areas is imminent. This places more emphasis on available well control systems in case conventional control systems, such as a blow out preventer and a subsurface safety valve, may fail.

WO-2008/154486-A2 discloses a state of the art blow out preventer system and deployment method for subsea wellbores. The system comprises a stack including a first and second ram blowout preventer.

The present invention aims to provide a method and system for well control in the exceptional event of a failure of such conventional blowout preventer.

The present invention therefore provides a capping stack for controlling a wellbore comprising:

- a number of interconnected and releasable modules, each module having a size and weight within predetermined limits;
- said modules including at least one ram type blow out preventer module;
- said modules including a connector module for connecting the capping stack to an attachment point of the wellbore;
- wherein the predetermined limits allow each module to be transported by cargo airplane.

According to another aspect, the invention provides a method for controlling a wellbore, comprising the steps of:

- providing a capping stack comprising a number of releasable modules, each module having a size and weight within predetermined limits, wherein said modules include at least one ram type blow out preventer module, and wherein said modules include a connector module for connecting the capping stack to an attachment point of the wellbore;
- transporting said modules by cargo airplane to a location near the wellbore;
- interconnecting the modules to provide the capping stack; and
- connecting the capping stack to the attachment point of the wellbore.

The capping stack and method of the present invention can be deployed in remote areas and/or in deep water. In addition, the capping stack is readily available, as it can be transported to said remote areas relatively easily using conventional means of (air) transport.

According to another aspect, the invention provides an accumulator for operating a ram type blow out preventer, the accumulator comprising:

- an outer housing having at least five inlet/outlet connections, each provided with a corresponding valve to open and close the respective connection;
- an inner cylinder arranged within said housing;
- an outer cylinder arranged between the inner cylinder and the housing, and which is moveable along the length of the inner cylinder;

- wherein an outside surface of the outer cylinder is provided with one or more flanges, each flange being fixed to the outer cylinder and engaging an inner wall of the housing;
- wherein a flange is fixed to the inner wall of the housing which engages the outer surface of the outer cylinder;
- wherein each fluid inlet/outlet is connected to a corresponding space within the housing.

The invention will be described hereinafter in more detail and by way of example with reference to the accompanying drawings in which.

As part of a new well control related contingency plan for floating drilling operations worldwide, the present invention provides a compact, modular and transportable capping stack for controlling a well in case conventional well control systems have failed. The capping stack comprises several modules, each of which fits into a readily available cargo plane, typically a Boeing 747 or similar aircraft. The requirement for air freight places significant weight constraints on the individual modules.

The capping stack of the invention is suitable for rapid deployment and use following a catastrophic loss of well control in remote areas or deep water. Due to the transportation by airplane, rapid deployment herein indicates within one or two weeks or even a few days. The capping stack of the invention is designed for deployment onto substantially any wellbore worldwide within ten days.

The Modular Well Capping Stack is assembled from a variety of possible module and component configurations.

Figure 1:
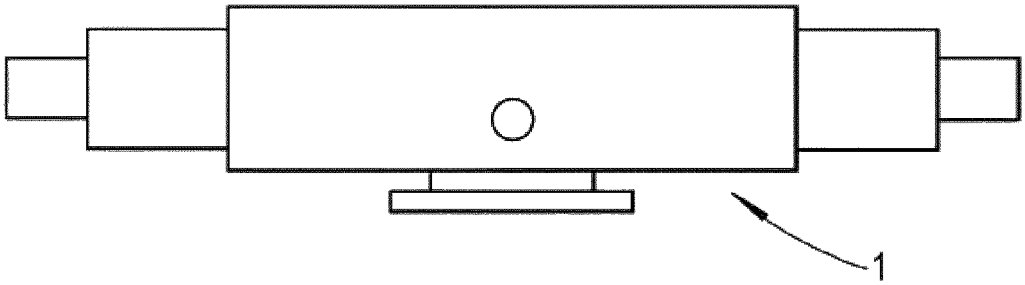
FIGS. 1 to 16 show respective embodiments of a capping stack of the invention, each comprising one or more modules.

FIG. 1 shows a module consisting of a single ram type blow out preventer (BOP) 1. The BOP may be outfitted with different types of ram type sealing elements. For the Modular Well Capping Stack of the present invention, each ram type blow out preventer is preferably selected from the group of shear rams and blind rams. The Modular Well Capping Stack may include one or more ram type BOPs assembled from individual ram modules.

Figure 2:
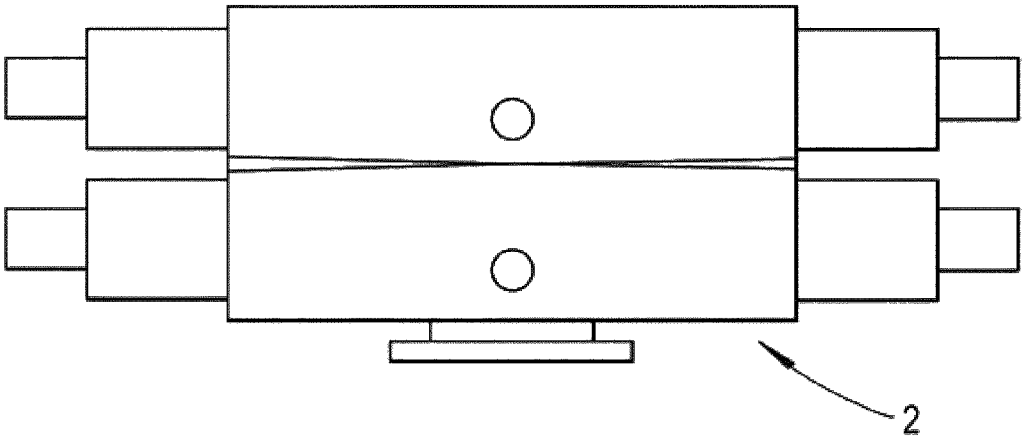

FIG. 2 shows a module comprising double ram type BOPs 1, 2. This is similar to FIG. 1 but two (or more) rams are combined into a single construction. A double ram may be interchanged with a single ram within the modules that comprise the Modular Well Capping Stack.

Figure 3:
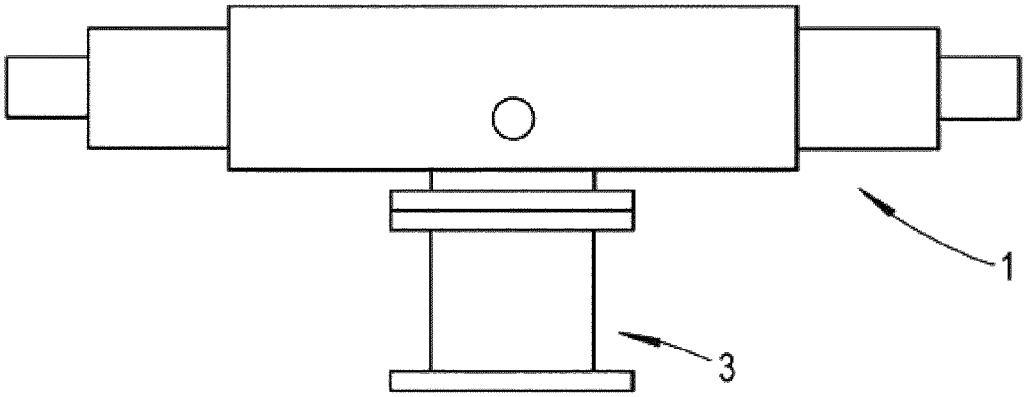

FIG. 3 shows a module with a single ram BOP 1 and with a detachable spacer spool 3 fitted below. The spacer spool 3 provides the desired spacing between ram modules in the Modular Well Capping Stack. Preferably, the spacer spools can be disconnected from the rams 1, 2 during transport to limit the size of individual modules.

Figure 4:
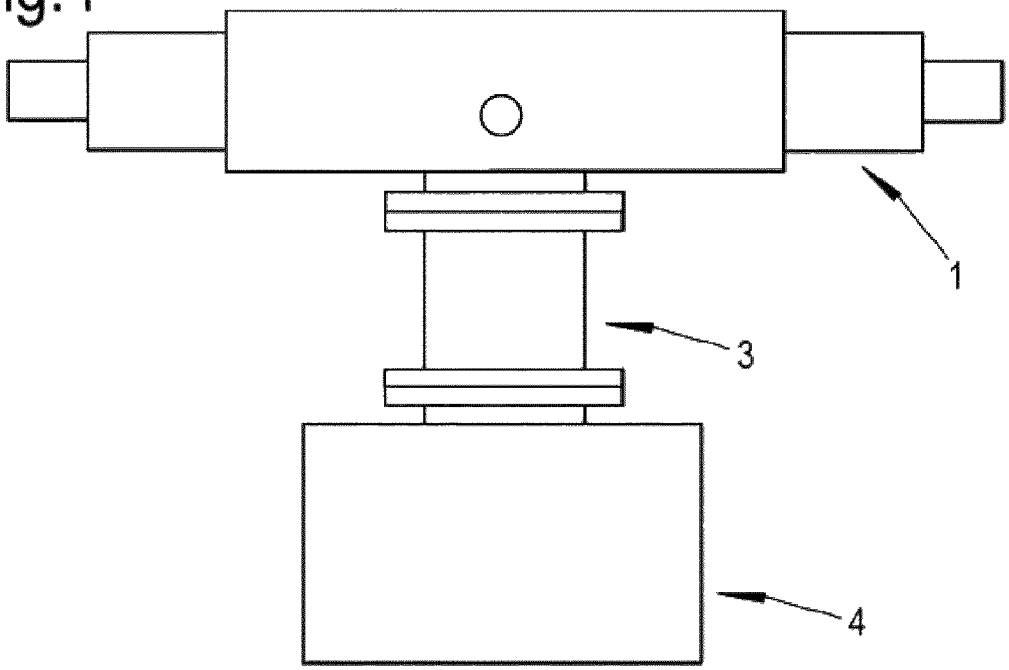

FIG. 4 shows a module with a single ram BOP 1 along with spacer spool 3 and with a hydraulic or mechanically operated connector 4. This connector may be used to connect modules together to construct the Modular Well Capping Stack or may be used to connect the Modular Well Capping Stack to an attachment point on a blown out well. The attachment point may be onto a marine riser adapter, a lower BOP stack connector mandrel, a wellhead mandrel, or elsewhere.

Figure 5:
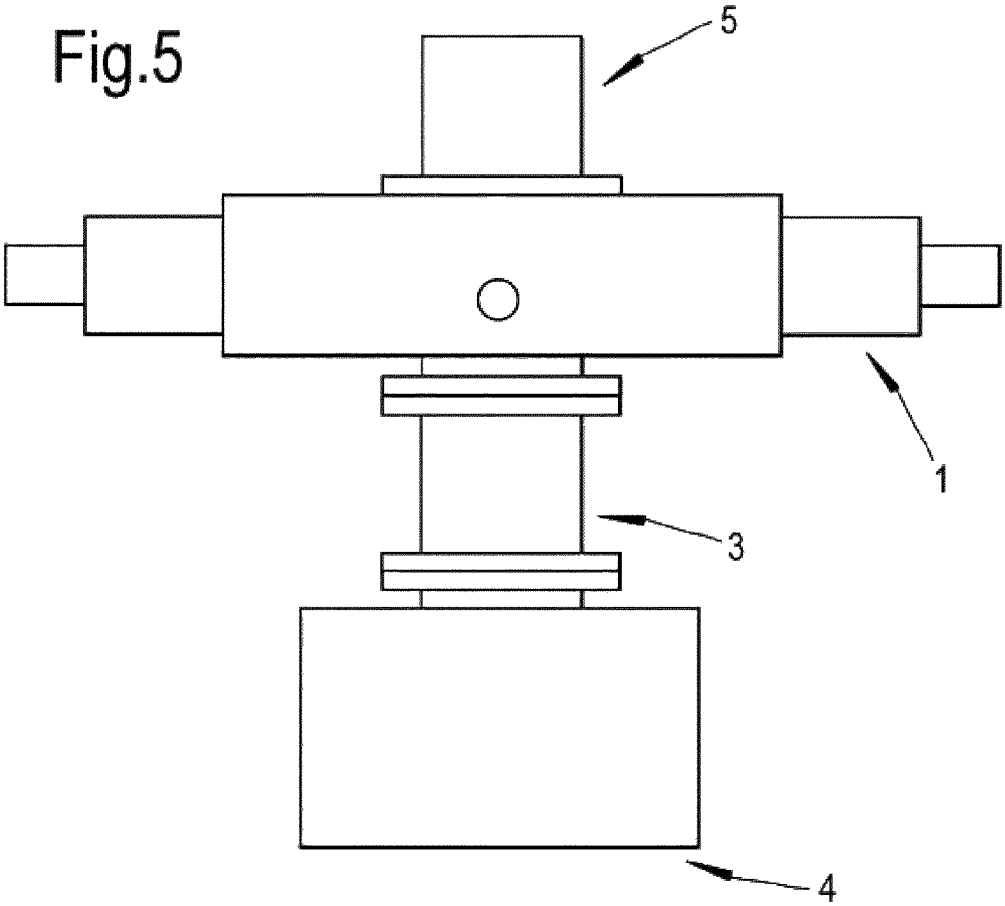

FIG. 5 shows a module including the components listed in FIG. 4 with the addition of a mandrel 5 on the top of the single ram BOP 1. This mandrel 5 may be used to attach components and modules above the ram BOP to extend the Capping Stack of the invention.

Figure 6:
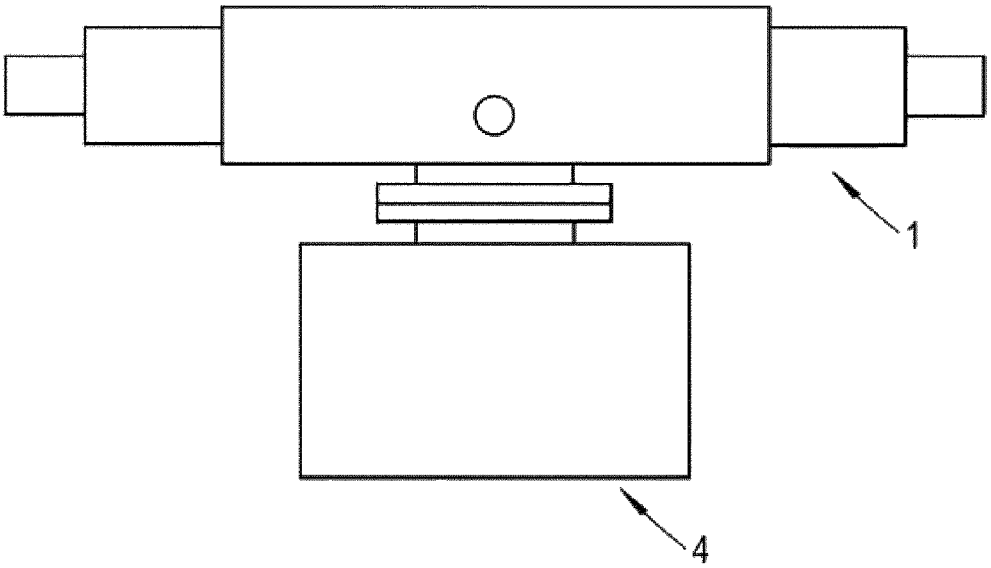

FIG. 6 shows a module comprising a hydraulic or mechanically operated connector 4 attached directly under a single ram BOP 1. This connector 4 may be used to connect modules together to construct the Capping Stack or may be used to connect the Modular Well Capping Stack to an attachment point on a blown out well. The attachment point may be onto a marine riser adapter, a lower BOP stack connector mandrel, a wellhead mandrel, or elsewhere.

Figure 7:
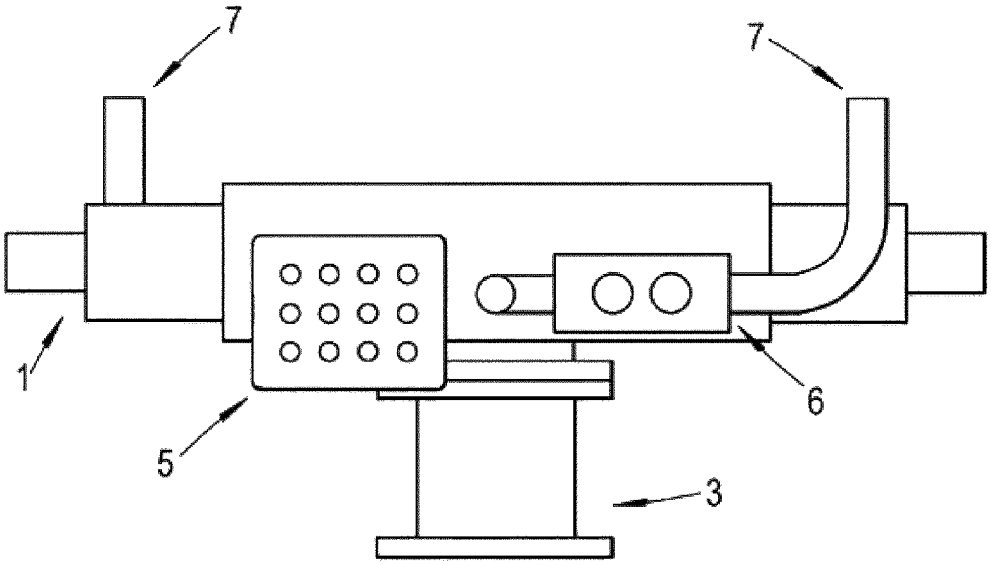

FIG. 7 shows a module comprising a single ram type BOP 1 with a spacer spool 3 fitted below. Added to these components are one or more control panels 5 and one or more valves 6 on side outlets of the ram BOP 1 along with flowlines 7 that may be used to direct fluids from or into the wellbore under the ram type BOP 1.

Figure 8:
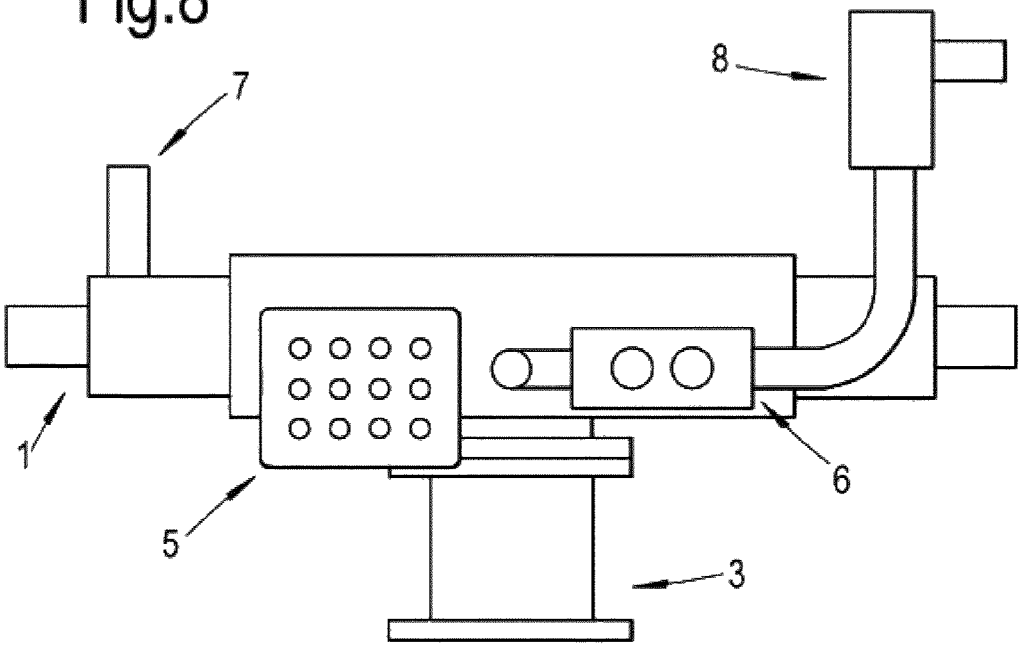

FIG. 8 shows accessories such as flow control chokes 8 attached to the flowlines on a single ram module.

Figure 9:
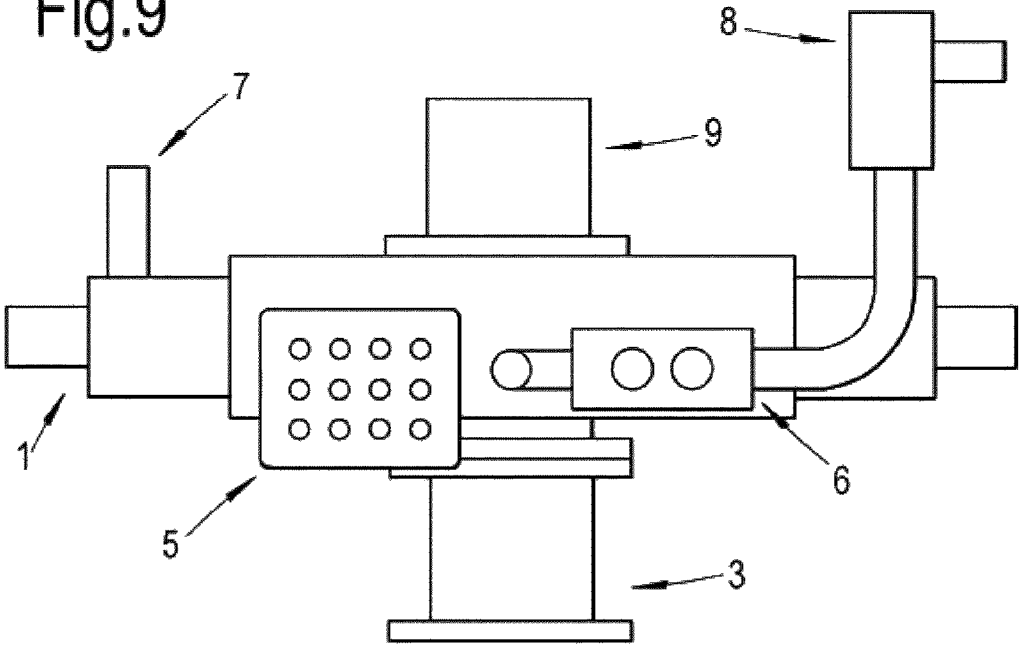

FIG. 9 shows a further module configuration with the addition of a mandrel 9 on the top of the single ram BOP 1.

Figure 10:
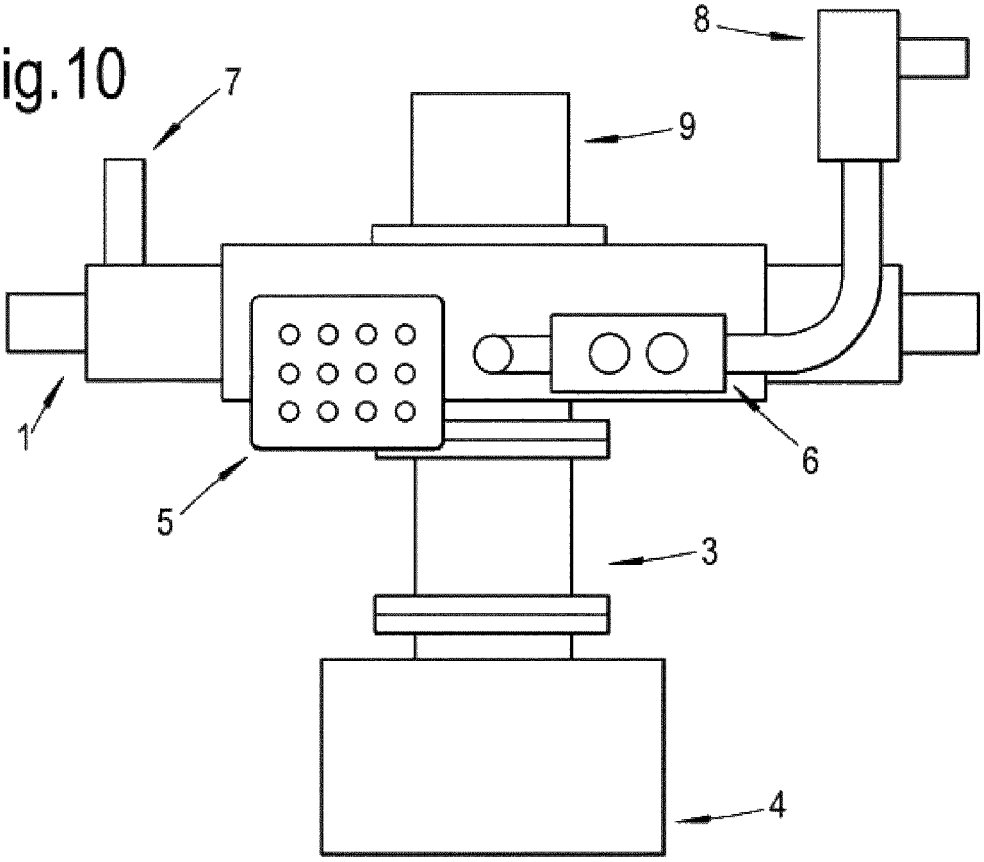

FIG. 10 shows a further module with a hydraulic or mechanically operated connector 4 below the spacer spool 3.

Figure 11:
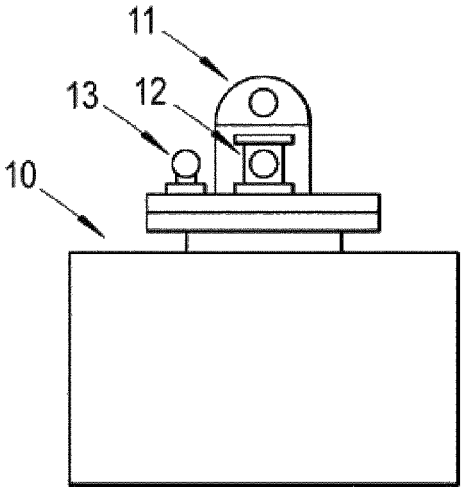

FIG. 11—Shows a mechanical or hydraulically operated connector 10 that may be attached to the top of a module. The connector 10 may be enclosed at the top with a blind flange containing accessories such as a lifting pad-eye 11, one or more outlets with one or more valves 12 to allow venting of trapped pressure below the connector, and/or a pressure gauge or sensor 13 to measure the presence of trapped pressure below the connector. The connector 10 may also be used to deploy the Modular Well capping Stack in certain circumstances.

Figure 12:
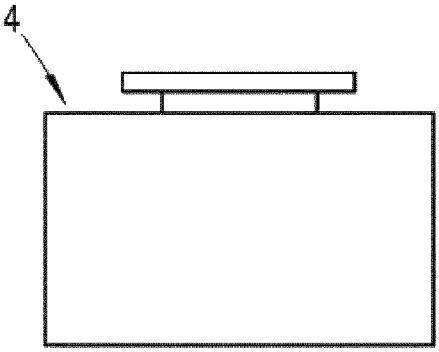

FIG. 12 shows a first module for commencement of assembly of the Modular Well Capping Stack of the present invention. The first module comprises a mechanical or hydraulically actuated connector 4.

Figure 13:
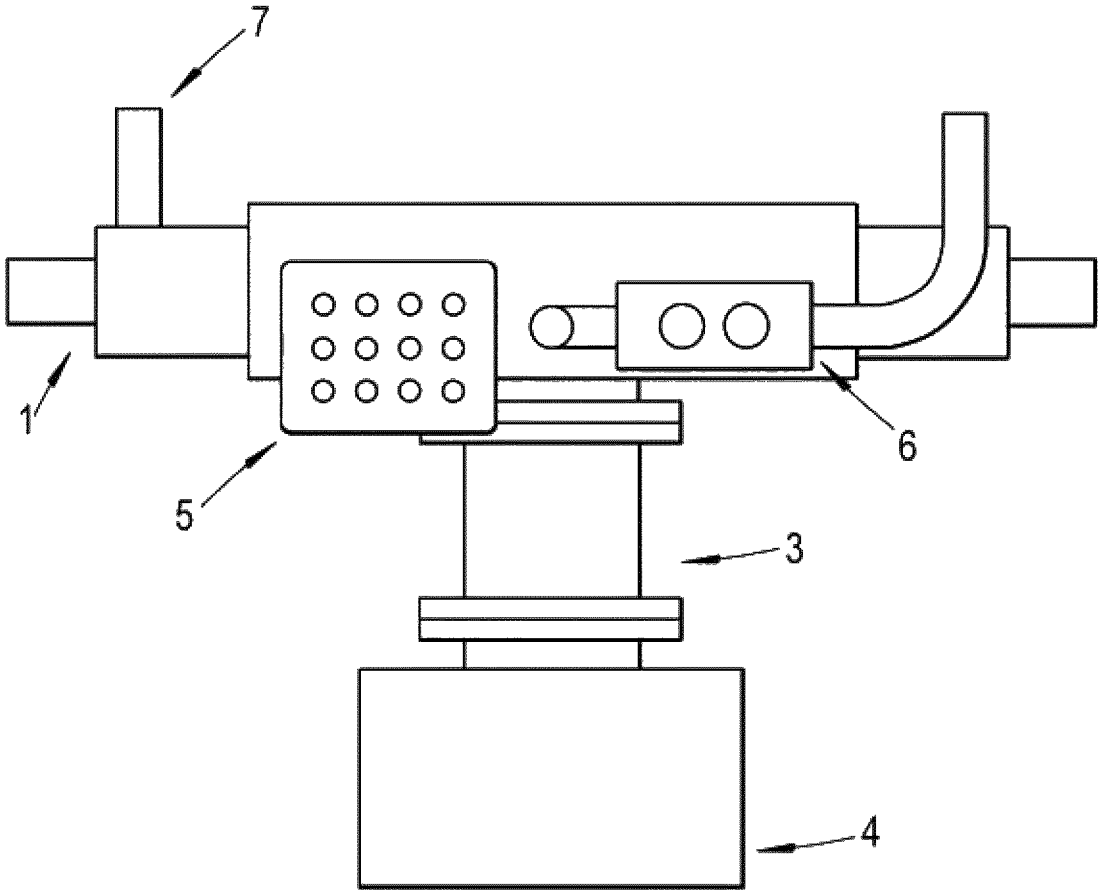

FIG. 13 shows a second module, comprising the components shown in FIG. 7, assembled on top of the connector module 4.

Figure 14:
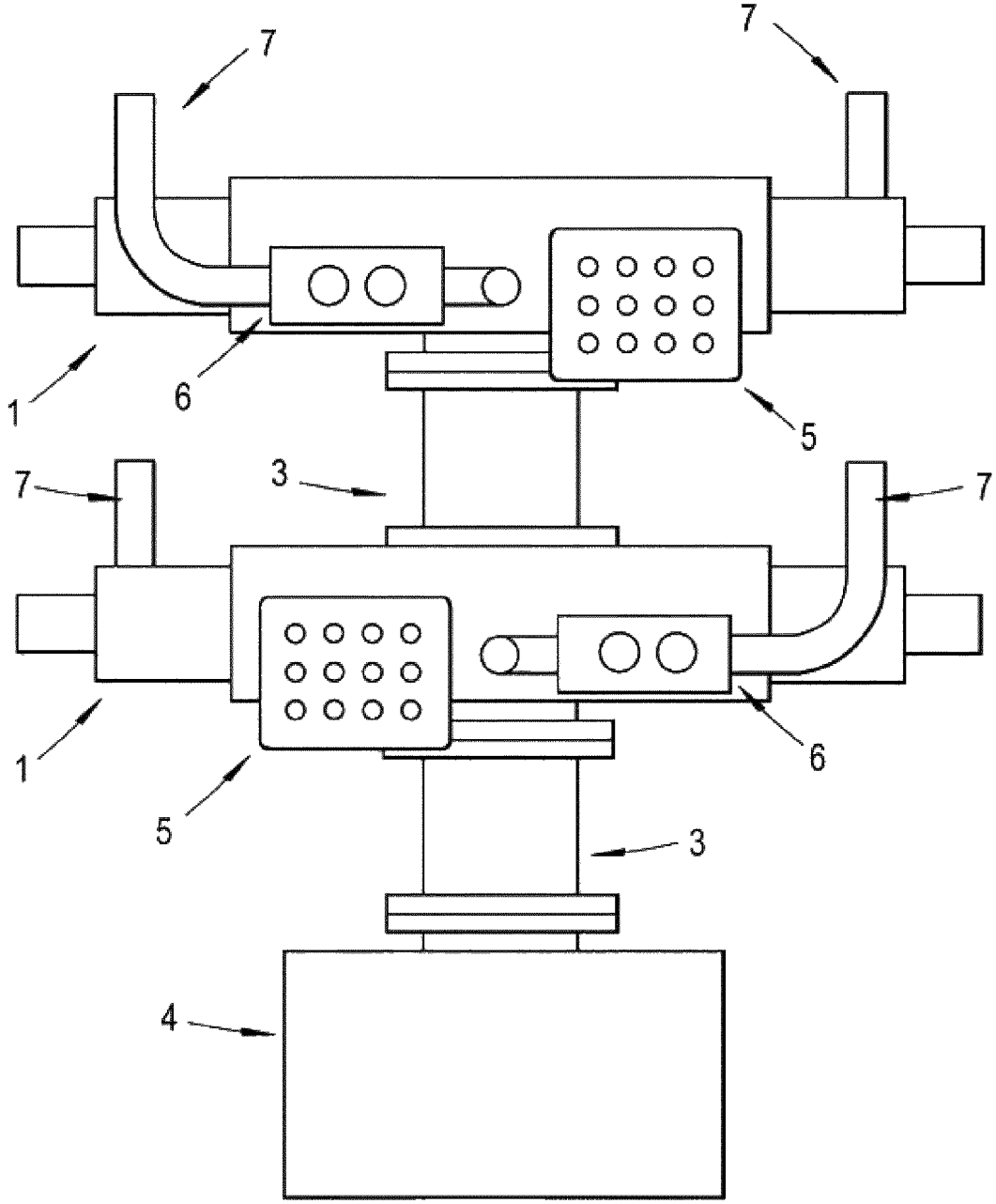

FIG. 14 shows a further module comprising the components shown in FIG. 7 assembled above the modules shown in FIG. 13. In this upper module, the orientation of the valves, flowlines and chokes have been mirrored as compared to the module below to provide clearance for adjacent components. The orientation of the valves and flowlines may be horizontal or vertical as clearance permits between modules. The individual capping stack ram modules may be radially staggered to provide clearance for valves and flowlines between modules. The flowlines may also be fabricated with bends to provide clearance between modules.

Figure 15:
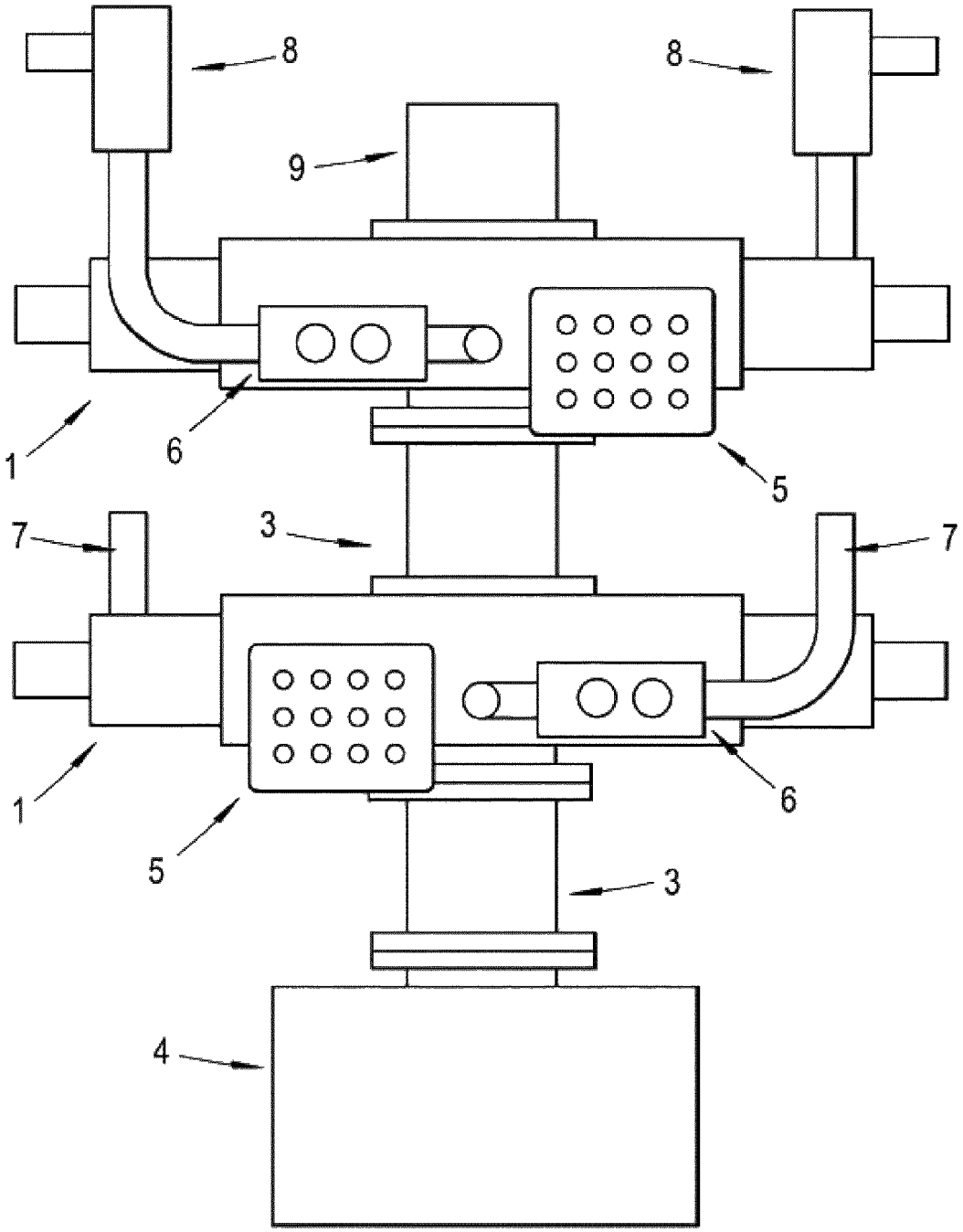

FIG. 15 shows a different upper module comprising the components shown in FIG. 8 assembled above the modules shown in FIG. 13.

Figure 16:
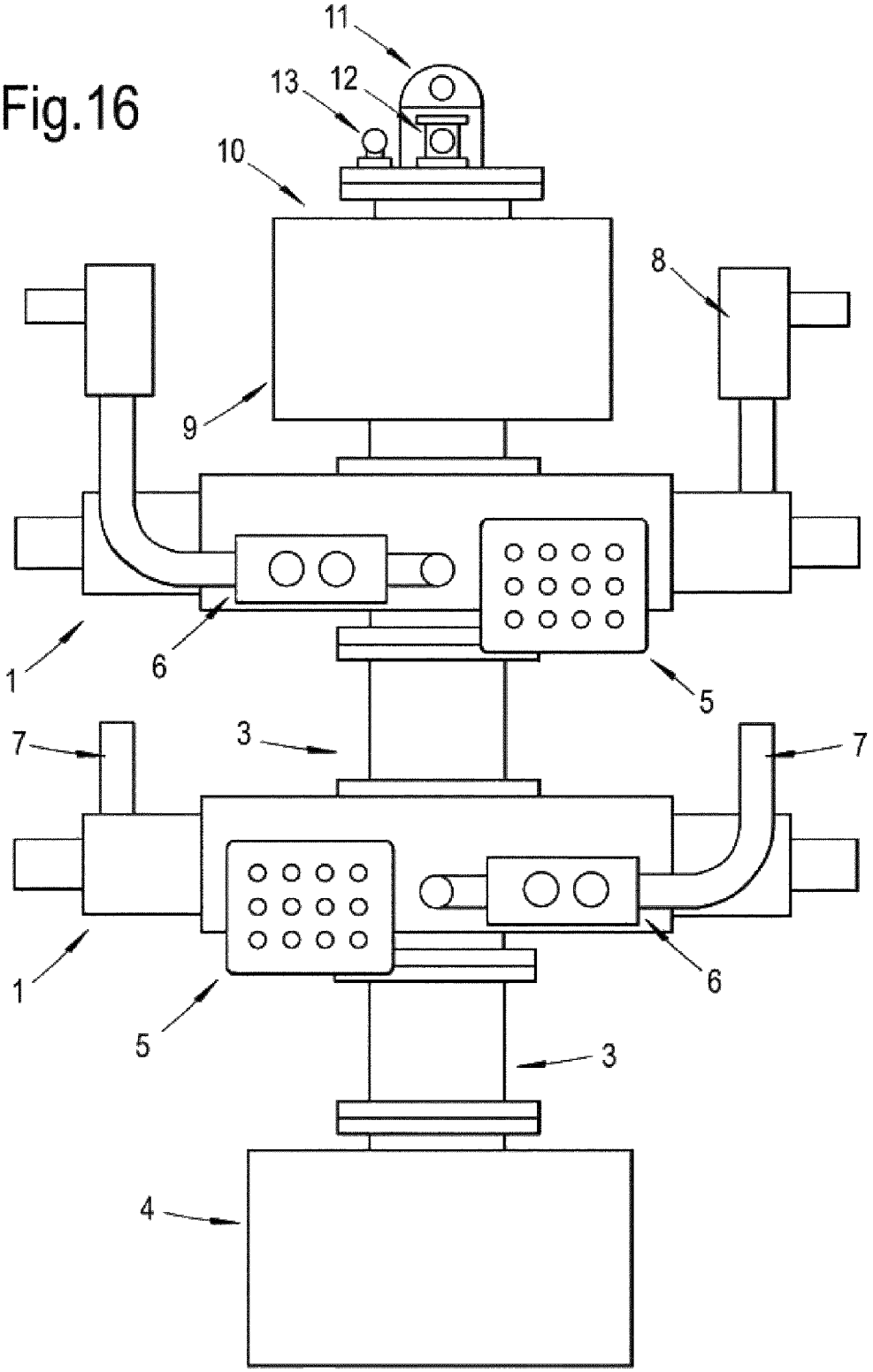

FIG. 16 shows an embodiment of the Modular Well Capping Stack of the invention assembled with the addition of the components listed in FIG. 11.

Figure 17:
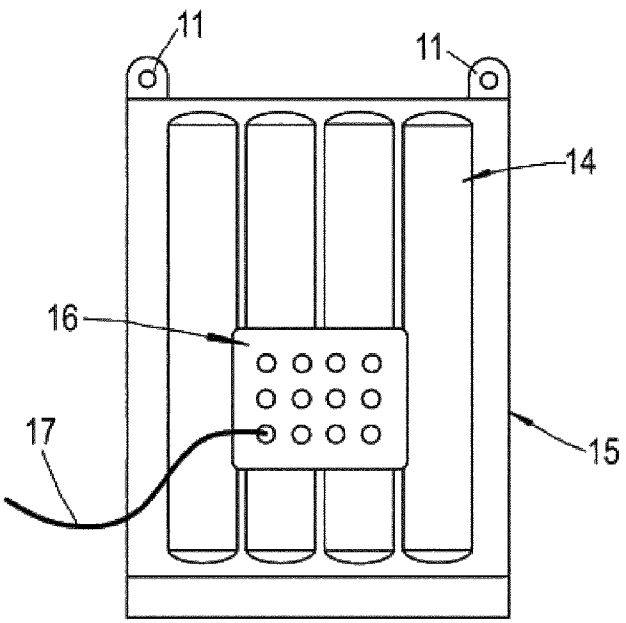
FIG. 17 shows a module for a capping stack of the invention, comprising accumulator bottles.

FIG. 17 shows a further module comprising hydraulic accumulators that store operating fluid. This operating fluid is contained in accumulator bottles 14 mounted in a rack 15. The hydraulic fluid can be directed to the ram type BOP modules 1, 2 or to the hydraulically operated connector modules 4 using control panel 16 to direct fluid through hydraulic flying leads 17.

The control panel 16 and the flying Leads 17 can be manipulated by means of a Remotely Operated (underwater) Vehicle (ROV). The accumulator bottled rack is intended to be lowered to and sit on the seabed nearby the blown out well. The accumulator bottles may be pre-charged with nitrogen to provide stored control fluid energy. Alternatively the accumulator bottles may be lowered to the seabed at atmospheric pressure with ambient seawater pressure providing the control fluid energy. The accumulator bottles may be charged at surface by means of a hydraulic pump or may be charged or re-charged at depth with an ROV operated pump. A hydraulic line may also be run to depth from surface to charge or re-charge the accumulator bottles. Some of the accumulator bottles may be used to store chemicals such as glycol to inhibit the formation of hydrates within or around the Modular Well capping Stack.

Figure 18:
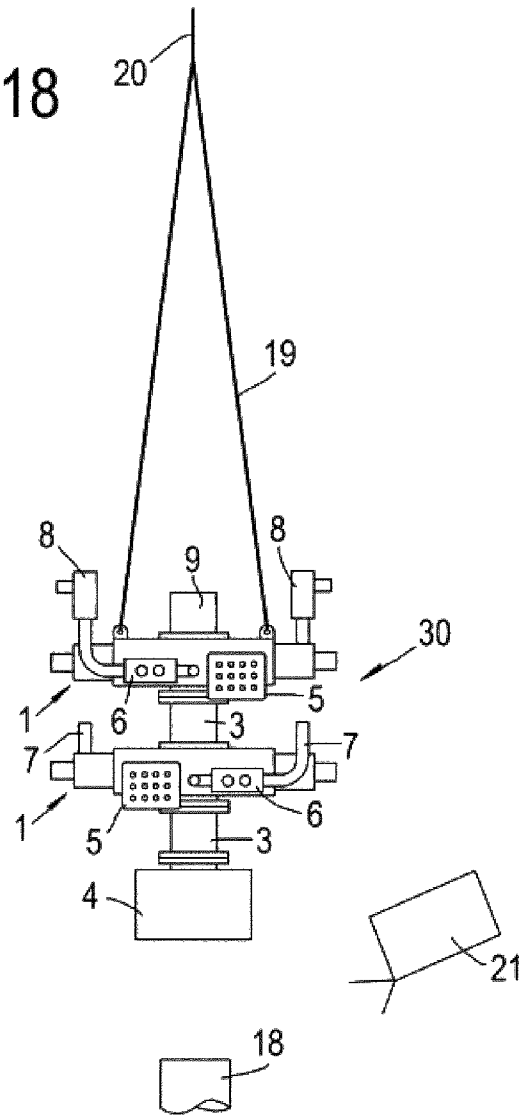
FIGS. 18 to 22 show respective method steps of deployment of an embodiment of the capping of the invention.

FIG. 18 shows the deployment of an assembled Modular Well Capping Stack 30 of the invention by a surface vessel or drill rig (not shown). The Modular Well capping Stack is hoisted by means of a winch using a lifting bridle 19 and lowered to the seabed by means of a winch line 20. The modular capping stack is preferably observed while running using an ROV 21 and is lowered towards the attachment point 18 of the blown out well.

Figure 19:
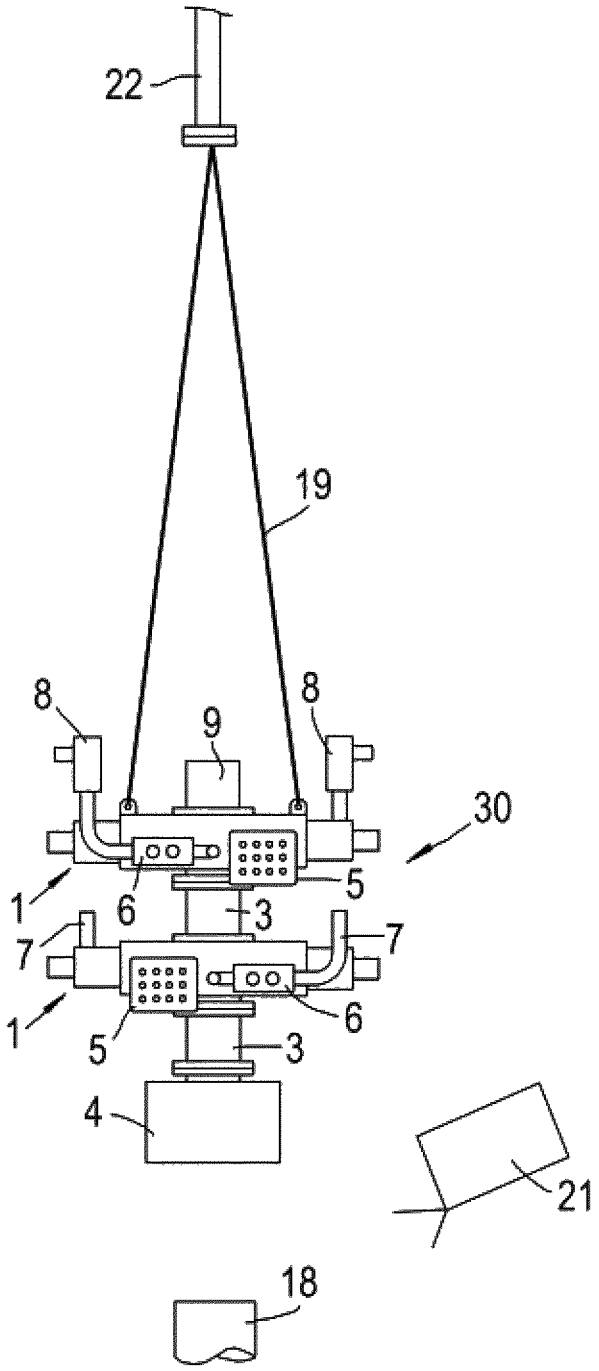

FIG. 19 shows the Modular Well Capping Stack 30 being lowered by a surface vessel or drill rig (not shown) using a lifting bridle 19 to the seabed by means of segmented tubular members 22 such as drillpipe or riser.

Figure 20:
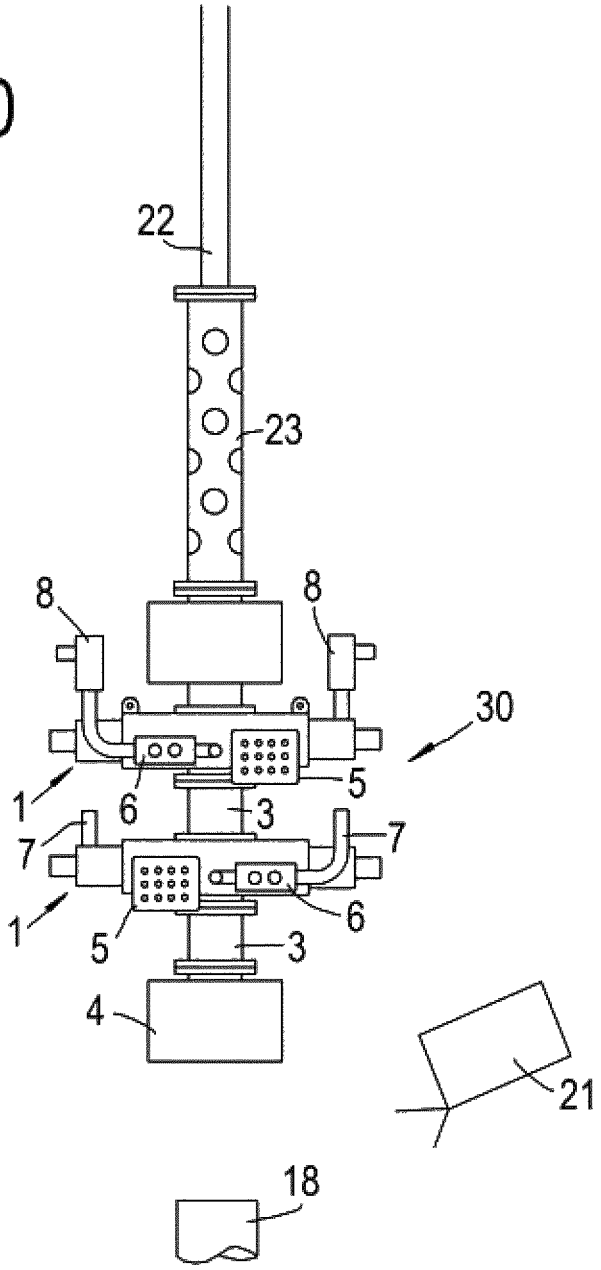

FIG. 20 shows the Modular Well Capping Stack 30 being lowered by a surface vessel or drill rig to the seabed using segmented tubular members 22 such as drillpipe or riser 22. A ported tubular member 23 provides egress for wellbore fluids from the blown out well and prevents fluid flow up the segmented tubular member 22 while lowering and stabbing the Modular Well Capping Stack over the blown out well attachment point 18.

Figure 21:
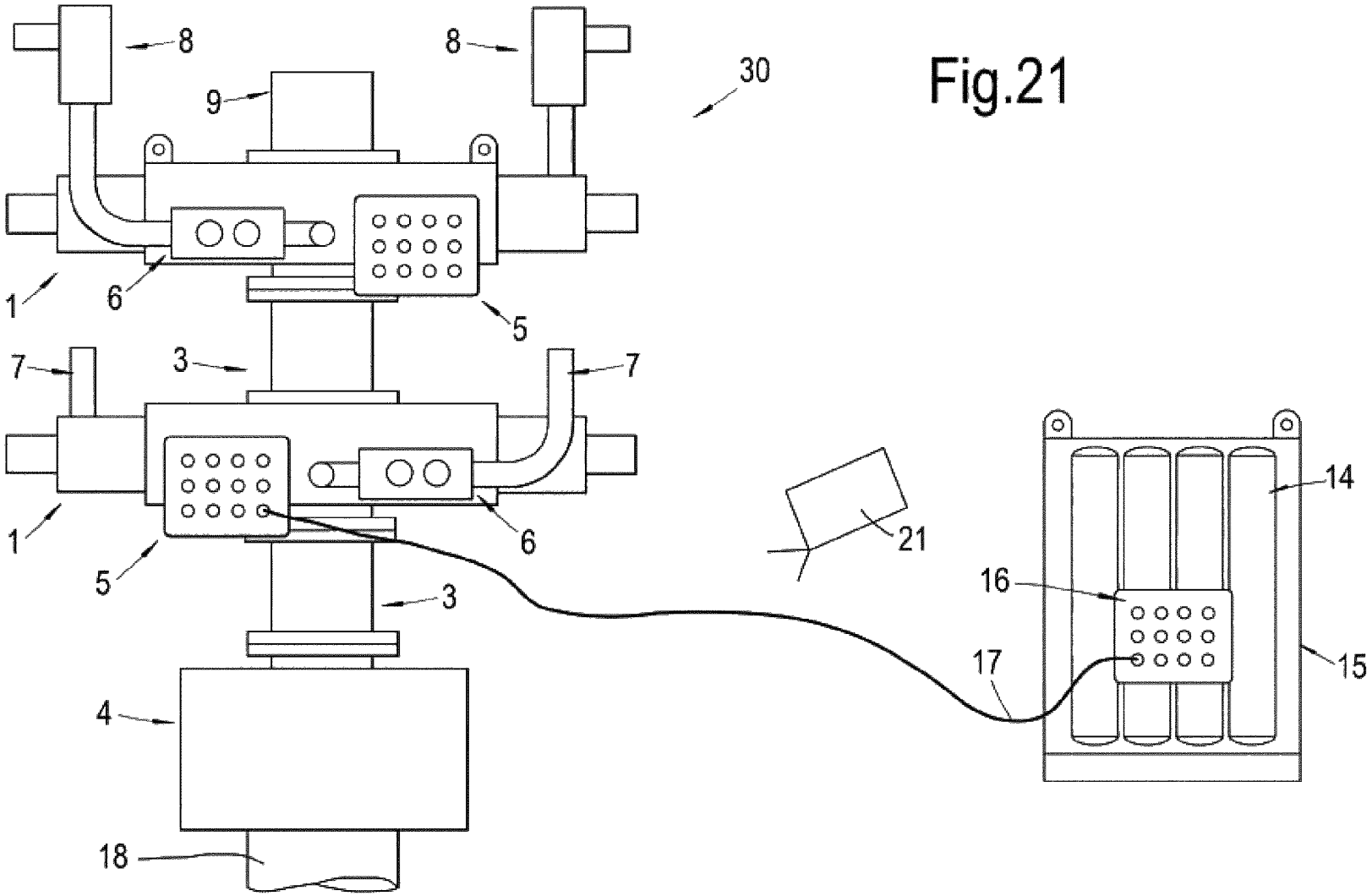

FIG. 21 shows the Modular Well Capping Stack 30 landed on the blown out well attachment point 18. The ROV 21 has connected the control system flying leads 17 to the control panels on the modular capping stack 5. Hydraulic fluid can now be released from the accumulators 14 by manipulating control valves on the controls panels 6 and 5 using the ROV. The hydraulic fluid enters the closing cylinder of the ram type BOPs 1 and closes the ram sealing elements. This closes in the wellbore and prevents further fluid from escaping to the environment. Further manipulation of fluid from and into the wellbore can be accomplished by manipulating valves 6 and chokes 8 again using the ROV 21.

Figure 22:
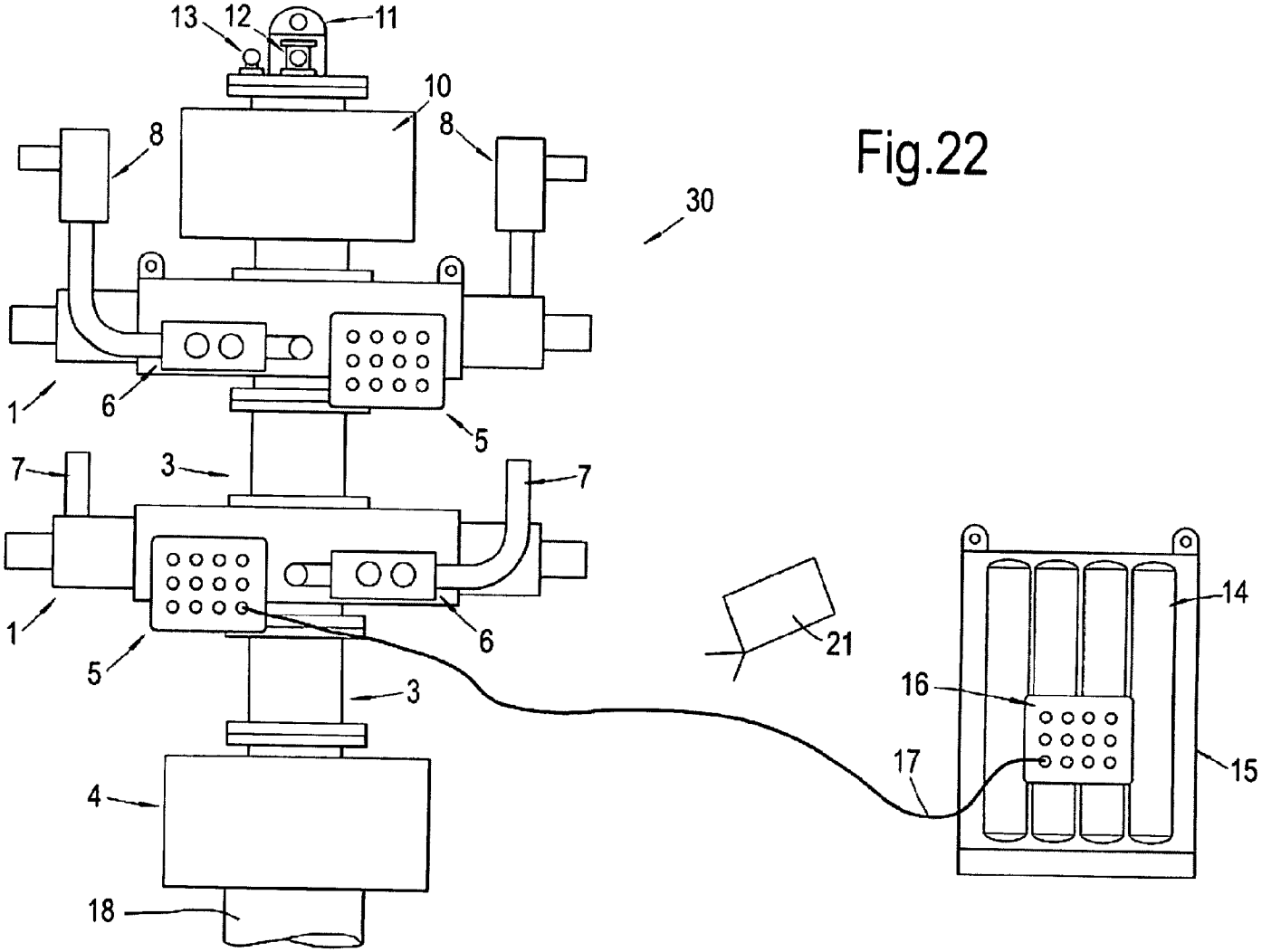

FIG. 22 shows the Modular Well Capping Stack 30 with a mechanical or hydraulically operated connector 10 as described in FIG. 11 placed on top. This connector 10, which may be blanked off with a blind flange, may provide an effective longer term isolation barrier than the ram type BOPs 1. This provides additional security in case the Modular Well Capping Stack 30 must remain in service for several weeks or months while a relief well is drilled or until a top kill can be performed.

Lifting and transportation is one of the main design features of the capping stack 30 of the invention. The modules may be further subdivided before transport to stay within predetermined weight limits. For instance, the spacer spools may be disconnected from the corresponding ram.

Individual modules are preferably equal to or less than about 20 ft long, 6 ft wide and 8.5 ft high. The maximum individual module weight is preferably 22,000 lbs, allowing three packaged modules per standard cargo aircraft. The equipment can be stored in a service ready state, preferably near a major international airport capable of handling Boeing 747-type cargo planes.

Each module may be provided with two or more connector eyes 11 for connecting hooks and cables and for lifting the module. Preferably said eyes are arranged in a symmetric fashion on opposite sides of the weight middle of the respective module.

The capping stack 30 of the invention can for instance be latched at angles up to 10 degrees inclination. The hydraulic connector 4 includes a connector of a swallow, high angle release type.

The capping stack 30 preferably includes two blind ram sealing elements. This is due to the higher volume of face seal rubber available on a blind ram and lower hydraulic volume required to close compared with a shear ram.

The capping stack is provided with at least one pressure and/or temperature transducer below each blind ram capable of analogue local display. optionally, each transducer enables interrogation and digital surface read-out via ROV 21.

The capping stack has a number of, for instance four, outlets. Each outlet is provided with two hydraulically controlled gate valves. Two of the outlets may be equipped with a manually controlled choke to perform a soft shut-in of the lower blind ram module. The ROV can control the gate valves (hydraulic) and chokes (manual).

The capping stack may be provided with an inlet to inject glycol or methanol to mitigate hydrate formation.

The capping stack is provided with one or more subsea accumulators 14 (FIG. 22). Combined, the one or more accumulators have sufficient capacity to close the connector, the (one, two or more) rams, the chokes and all (for instance eight) valves without re-charge. The accumulators can be designed to extend the capping stack operating water depth, for instance to 12,000 ft or more.

In an embodiment, each ram module 1, 2 is provided with, or coupled to, one or more corresponding accumulators, for instance two to four accumulators 14 per ram. Herein, each accumulator functions as a pressure intensifier. The accumulators can be packaged for air freight, for instance in a single module in the rack 15, as shown in FIG. 17.

Figure 23:
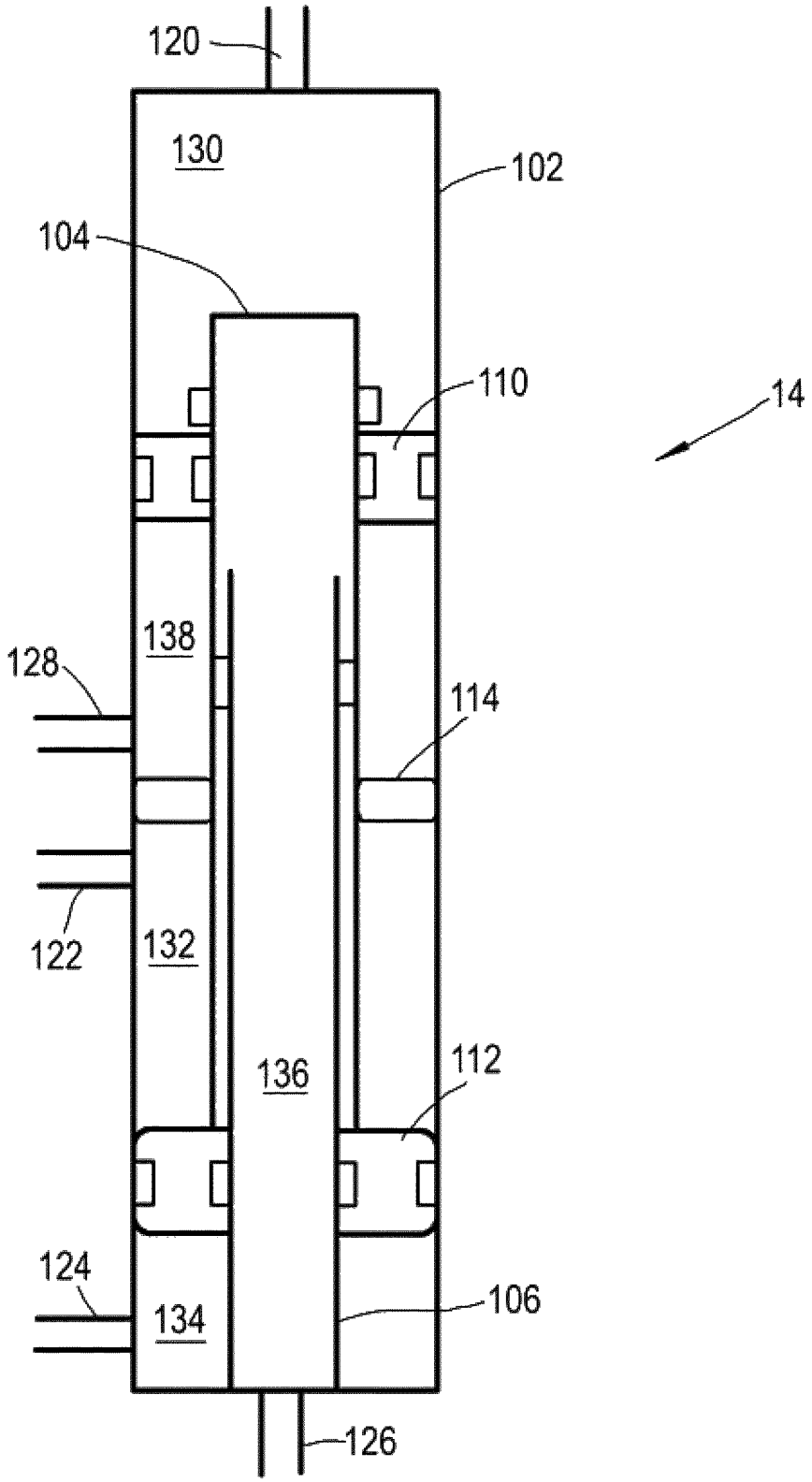
FIG. 23 shows an embodiment of an accumulator according to the present invention.

In a preferred embodiment shown in FIG. 23, the accumulator 14 comprises an outer housing 102 enclosing an outer cylinder 104 and an inner cylinder 106. The outer cylinder is moveable along the length of the inner cylinder. The outside surface of the outer cylinder is provided with one or more flanges, for instance a first flange 110 and a second flange 112. Each flange is fixed to the outer cylinder 104, and engages the inner wall of the housing 102. A third flange 114 is fixed to the inner wall of the housing and engages the outer surface of the outer cylinder 104.

The housing is provided with a number of fluid inlets or outlets, for instance first to fifth inlet/outlet 120, 122, 124, 126 and 128 respectively. Each inlet/outlet is connected to a corresponding space within the accumulator housing 102, for instance first to fifth space 130, 132, 134, 136 and 138 respectively.

The accumulator 14 of the invention can be connected and operated in a number of ways. Herein below, three examples thereof are described. For convenience, all inlets/outlets are indicated as inlets. All said inlets can be opened and closed using corresponding valves, which however are not shown in the drawings.

In a first mode of operation, the accumulator can be actuated by the hydrostatic pressure of the body of water in which it is located. Herein, the first inlet 120 is connected to atmospheric pressure, the valve of the second inlet 122 is closed and connects the second inlet to the surrounding hydrostatic pressure. The third inlet 124 is connected to vacuum or to a hydraulic fluid. The fourth and fifth inlet 126, 128 respectively are connected to hydraulic fluid to control one or more modules of, for instance, the capping stack 30.

Resetting in this concept is possible by adding the floating piston and the fifth inlet 128. By applying pressure on the fourth inlet 126 and fifth inlet 128 at the same time, the system can be reset against the hydrostatic pressure on the first inlet 120. After resetting, the valve of the first inlet 120 can be closed, and the spaces corresponding to the remaining inlet be evacuated.

In a second mode of operation, the accumulator can be used to provide an increased output pressure in response to a certain input pressure, both on land or subsea. Herein, the first and second inlet 120, 122 are connected to a pre-charge pressure, for instance provided by a N2 pre-charge vessel (not shown). The third inlet 124 is connected to vacuum, and the fourth and fifth inlet 126, 128 respectively are connected to hydraulic fluid to control one or more modules of, for instance, the capping stack 30.

In a third mode of operation, the accumulator can be run as a super-charged accumulator, both on land or underwater. Herein, the first inlet 120 is connected to a relatively low pressure, for instance provided by a vessel filled with N2. The second inlet 122 connects to a pre-charge of for instance N2. The third inlet 124 is connected to vacuum, and the fourth and fifth inlet 126, 128 respectively are connected to hydraulic fluid to control one or more modules of, for instance, the capping stack 30.

Figure 24:
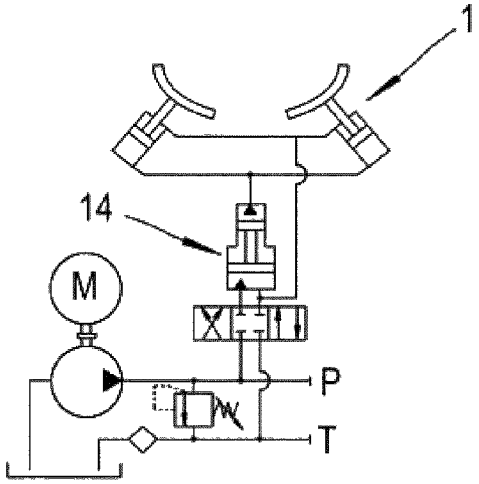
FIGS. 24, 25 and 26 schematically show an activation system for a ram type blow out preventer, the system including the accumulator of the invention.
Figure 25:
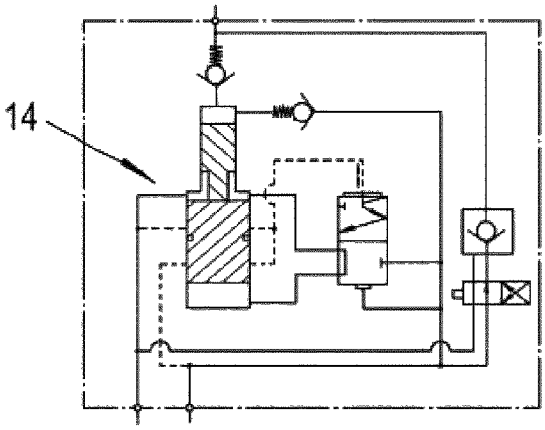
Figure 26:
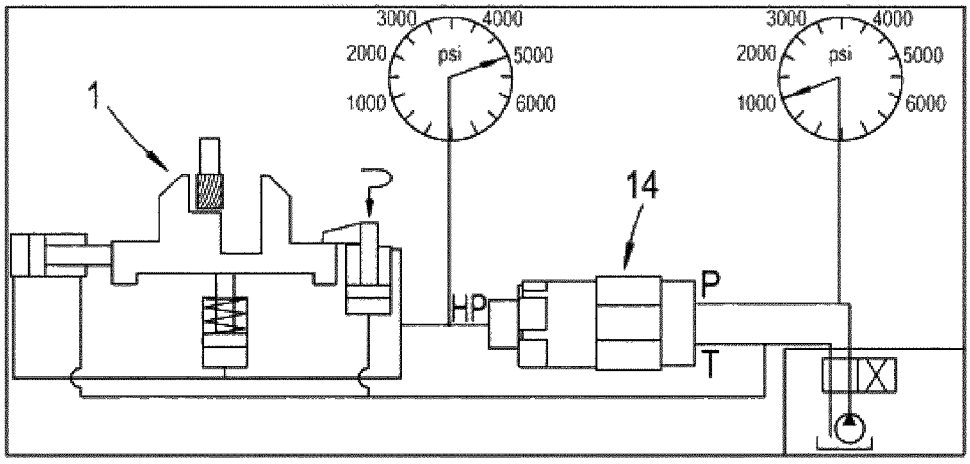

FIGS. 24, 25 and 26 show how the accumulator 14 can be connected to activate for instance the ram 1. Herein, the accumulator 14 uses seawater hydrostatic pressure to energize the system.

In an exemplary embodiment, the accumulator 14 can for instance deliver in the order of 30 to 45, for instance 36.5 gal (40 gal including 1.1 SF), and about 5,000 to 8,000 psi, for instance 6,850 psi, at about 8,000 to 12,000 ft water depth.

The accumulator of the present invention is for instance also suitable for land rigs or conventional (subsea) BOPs. The accumulator will enable to use less accumulators and will allow higher shear pressures, for instance up to about 5000 psi or more. The accumulator will obviate an additional high pressure pump. Super charged pressure can be set by connecting a regulator on the third inlet 124 using a shuttle valve.

Each individual module is preferably provided with an ROV panel for control of the respective module. This eliminates interconnect piping between individual modules, simplifying the control system design. Stand alone controls per module also allow testing each module during storage without the need to assemble the entire capping stack.

The capping stack shall be fitted with means, such as a bull's-eye, to determine inclination.

ROV control valves are preferably three-way type, including Open/Vent/Close functions. Each ram close function is provided with a pilot operated check valve to keep the ram locked until the ROV activates manual locking screws.

All fluid requirements (e.g. power fluid or glycol) can be provided either by the ROV or via flying leads from a subsea accumulator manifold. However, using the accumulators to supply power fluid will be the preferred choice for fast operation of a function.

The system shall has an inlet to let an ROV inject methanol for remediation if hydrate related issues occur, for instance prior to disconnect and recovery.

The capping stack may be deployed from a drill rig on drill pipe or a from a service vessel from a winch line. In either case the deployment rigging is similar. In either case the capping stack will be assembled by connecting all the respective modules, for instance at the rig.

The capping stack of the invention is deployed open ended with full flow area available during placement over a wellbore. Prior to deployment of the capping stack, debris (e.g. drill pipe) that could interfere with landing and/or latching the capping stack in or around are preferably removed. This can be done by divers, or at greater depths by an ROV using diamond wire saw, a cutter or other means.

The capping stack is provided with ROV handles (not shown) to facilitate turning the capping stack for alignment relative to the wellhead or top of the BOP in case of possible debris or obstructions.

A suitable work class ROV 21 is preferably available at the rig. Such ROV may have hydraulic fluid, glycol (and methanol) injection capability, to inject these fluids into inlets of the capping stack.

In a method of well control according to the invention, the capping stack is connected to the top of the existing BOP or to the wellhead. If the capping stack is connected to the BOP, initially a so-called lower marine riser package (LMRP) cap containment system will preferably be disconnected from the BOP prior to capping stack deployment. The capping stack does not need to connect to a riser pipe stub, or flex joint flange.

The capping stack of the present invention may be suitable to control wells at pressures up to, for instance, about 10,000 psi or 12,000 psi or more. To limit the weight of respective modules, the operating area targeted for the capping stack is for wells worldwide within the 10,000 psi working pressure range, in up to about 10,000 ft water depth. These limits may be extended though, for instance using more powerful modules or more or more powerful accumulators.

The purpose of the capping stack is to provide the mechanical components necessary to perform a well capping operation. The capping stack is designed to connect to a wellbore interface of the wellbore and to shut-in the flow from the wellbore. Said wellbore interface may be at the top of an existing blowout preventer (BOP) or at the (subsea) wellhead, in which case the BOP must have been removed.

Two scenarios relating to subsea wells were considered in the design of the capping stack: 1) The rig is lost (compare to the Macondo blowout in the Gulf of Mexico in 2010); and 2) the rig is saved by disconnecting the riser. If the rig is lost, deployment will take more time.

The capping stack can perform:

1. A bullhead top kill operation that could involve pumping both kill mud and cement into the well through the capping stack side inlets. This would be considered if wellbore pressure integrity confirmed and suitable pump-in flow paths via the choke and kill lines on the subsea BOP are not available or inadequate.

2. A cap and collect operation in order to mitigate the environmental consequences of the well control incident. This would be attempted in the event the wellbore pressure or wellbore integrity is compromised to an extent that would precluded complete shut-in of the wellbore. The capping stack does provide the ability to perform well kill by means of bull heading within the pressure limitations of the equipment and wellbore.

The equipment must be ready for mobilization by airfreight around the world to where it is needed, preferably using only readily available 747 type transport aircraft that provide cargo services to most of the international airports near offshore operations. The capping equipment is configured to ensure it can be mobilized, prepared for deployment and deployed on a subsea well, preferably within 10 days worldwide.

The individual module package weight is limited to 22,000 lbs, allowing three module packages per typical 747 type cargo plane. Individual packages are no larger than 20 ft long×6 ft wide×8.5 ft high. Larger packages weighing up to 44,000 lbs each can be accommodated as 747 main deck cargo, but with the limitation that each airplane can only transport one such package at a time. The design ensures that all the required individual capping stack modules can be transported using a relatively small number of flights, preferably equal to or less than 3 flights. The modules can also be shipped or stored in a standard sea transport container.

The capping stack is preferably compatible with common wellhead mandrels and BOP mandrels, i.e. can be attached thereto. These mandrels include for instance 18¾" Vetco H4 10 k or 15 k profiles (27" OD) and BOP mandrels such as 18¾" 10 k Cameron AX hub or Vetco H4 style.

The present invention is not limited to the above-described embodiments thereof, wherein various modifications are conceivable within the scope of the appended claims. For instance, features of respective embodiments may be combined.

The invention claimed is:

1. Accumulator for operating a ram type blow out preventer, the accumulator comprising:

an outer housing having at least five inlet/outlet connections, each provided with a corresponding valve to open and close the respective connection;

an inner cylinder arranged within said housing;

an outer cylinder arranged between the inner cylinder and the housing, and which is moveable along the length of the inner cylinder;

wherein an outside surface of the outer cylinder is provided with one or more flanges, each flange being fixed to the outer cylinder and engaging an inner wall of the housing;

wherein a flange is fixed to the inner wall of the housing which engages the outer surface of the outer cylinder;

wherein each fluid inlet/outlet is connected to a corresponding space within the housing.

2. The accumulator of claim 1, the accumulator being drivable by hydrostatic pressure of a body of water in which the accumulator is located, wherein:

a first inlet is connected to atmospheric pressure;

the valve of a second inlet is closed and connects the second inlet to the surrounding hydrostatic pressure;

a third inlet is connected to vacuum or to a hydraulic fluid;

a fourth and a fifth inlet respectively are connected to hydraulic control fluid.

3. The accumulator of claim 2, wherein the accumulator is resettable against the hydrostatic pressure on the first inlet by pressurizing the hydraulic control fluid on the fourth inlet and the fifth inlet at the same time.

4. The accumulator of claim 1, wherein:

a first and a second inlet are connected to a pre-charge pressure;

a third inlet is connected to vacuum;

a fourth and a fifth inlet respectively are connected to hydraulic control fluid.

5. The accumulator of claim 1, wherein:

a first inlet is connected to a relatively low pressure;

a second inlet is connected to a pre-charge;

a third inlet is connected to vacuum; and a fourth and a fifth inlet respectively are connected to hydraulic control fluid.

6. A capping stack for controlling a wellbore comprising the accumulator of claim 1.

7. The capping stack of claim 6 comprising:

a plurality of interconnected and releasable modules, each module having a size and weight within predetermined limits;

said modules including at least one ram type blow out preventer module;

said modules including a connector module for connecting the capping stack to an attachment point of the wellbore;

wherein the predetermined limits allow each module to be transported by cargo airplane.

8. The capping stack of claim 7, wherein the predetermined size limits ensure that each module is equal to or less than about 20 ft long, 6 ft wide and 8.5 ft high.

9. The capping stack of claim 7, wherein the predetermined weight limits ensure that each module weighs equal to or less than about 22,000 lbs.

10. The capping stack of claim 7, wherein at least one of the modules is provided with at least two lifting pad-eyes for lifting said module.

11. The capping stack of claim 10, wherein the at least two lifting pad-eyes are arranged symmetrically with respect to the weight middle of the module.

* * * * *